US010352672B2

(12) United States Patent
Partanen

(10) Patent No.: US 10,352,672 B2
(45) Date of Patent: Jul. 16, 2019

(54) CARTRIDGE PACKAGE

(71) Applicant: Venandi Oy, Hautjarvi (FI)

(72) Inventor: Seppo Sakari Partanen, Hautjarvi (FI)

(73) Assignee: VENANDI OY, Hautjarvi (FI)

( * ) Notice: Subject to any disclaimer, the term of this patent is extended or adjusted under 35 U.S.C. 154(b) by 0 days.

(21) Appl. No.: 16/094,727

(22) PCT Filed: May 8, 2017

(86) PCT No.: PCT/FI2017/050352
§ 371 (c)(1),
(2) Date: Oct. 18, 2018

(87) PCT Pub. No.: WO2017/194831
PCT Pub. Date: Nov. 16, 2017

(65) Prior Publication Data

US 2019/0120604 A1 Apr. 25, 2019

(30) Foreign Application Priority Data

May 9, 2016 (FI) ..... 20165393

(51) Int. Cl.
*F41A 9/83* (2006.01)
*F42B 39/00* (2006.01)
*F41A 9/82* (2006.01)
*F42B 39/26* (2006.01)

(52) U.S. Cl.
CPC ..... *F42B 39/002* (2013.01); *F41A 9/82* (2013.01); *F42B 39/26* (2013.01)

(58) Field of Classification Search
CPC ..... F41A 9/66; F41A 9/82; F41A 9/83; F41A 9/84; F42B 39/002; F42B 39/26
USPC ..... 42/87
See application file for complete search history.

(56) References Cited

U.S. PATENT DOCUMENTS

| | | | | |
|---|---|---|---|---|
| 2,783,570 | A | 3/1957 | Kunz | |
| 3,789,531 | A | 2/1974 | Kersten | |
| 3,906,652 | A | 9/1975 | Evans | |
| 4,352,254 | A | 10/1982 | Peter et al. | |
| 4,408,409 | A | 10/1983 | Arias L | |
| 9,921,015 | B1 * | 3/2018 | Roe | F41A 9/83 |

(Continued)

FOREIGN PATENT DOCUMENTS

| | | |
|---|---|---|
| WO | WO 8901128 | 2/1989 |
| WO | WO 03023308 | 3/2003 |

*Primary Examiner* — J. Woodrow Eldred
(74) *Attorney, Agent, or Firm* — Leason Ellis LLP

(57) ABSTRACT

The cartridge package (100) comprises an elongated housing (110) with a first 5 compartment (120) being divided into two sub-compartments (121, 122) with a flexible intermediate wall (117). Each sub-compartment receives a row (R1, R2) of cartridges (150). Opposite side walls (111, 112) of the housing are provided with a longitudinal slot (160, 162). A mouth portion (130) extending outwards from a top end (E2) of the housing comprises a second compartment 10 (135) having an open top end (E3) and being adapted to receive a mouth portion of a first cartridge magazine in order to load the cartridges from the cartridge package into the first cartridge magazine. The width of each longitudinal slot is dimensioned to receive an edge of a second cartridge magazine in order to push a respective row of cartridges from the cartridge package into the first cartridge magazine.

10 Claims, 6 Drawing Sheets

(56) References Cited

U.S. PATENT DOCUMENTS

Figure 1:
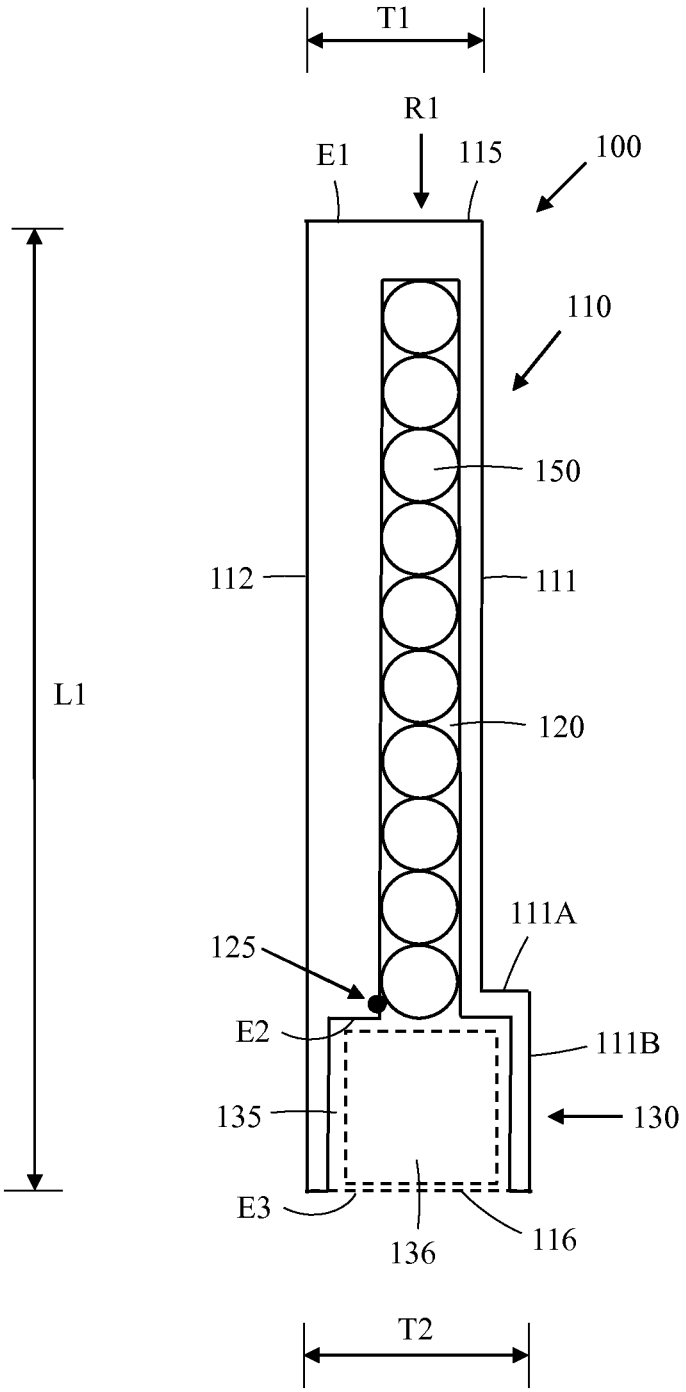

| | | | | |
|---|---|---|---|---|
| 10,132,582 | B1 * | 11/2018 | Zhou | F41A 9/83 |
| 10,139,176 | B1 * | 11/2018 | Witecha | F41A 9/83 |
| 2012/0255211 | A1 | 10/2012 | Kim | |
| 2015/0377573 | A1 | 12/2015 | Niccum | |
| 2017/0030670 | A1 * | 2/2017 | Kim | F41A 9/83 |

* cited by examiner

CARTRIDGE PACKAGE

CROSS-REFERENCE TO RELATED PATENT APPLICATIONS

This application is a U.S. National Phase Application under 35 U.S.C. § 371 of International Patent Application No. PCT/FI2017/050352, filed May 8, 2017, which claims the priority of Finnish Application No. 20165393, filed May 9, 2016, each of which is incorporated by reference as if expressly set forth in its entirety herein.

FIELD

The invention relates to a cartridge package.

BACKGROUND

Cartridges are packed into cartridge packages in which the cartridges are stored and sold to users. The cartridge packages are often disposable and thrown away when the cartridge package is empty. Cartridge packages may be such that the cartridges are loaded from the cartridge package by hand one by one into the cartridge magazine of the weapon. Cartridge packages may on the other hand be such that the cartridges are loaded from the cartridge package by hand several or all at a time into a detachable cartridge magazine of an automated or half-automated weapon. Cartridge magazines are normally loaded with cartridges from an opening provided in a mouth portion of the cartridge magazine. The loading is done against a spring force provided within the cartridge magazine. An empty cartridge magazine is filled with cartridges from the opening provided in the mouth portion of the cartridge magazine. A soldier carries in combat situations several e.g. 5 full cartridge magazines with him and changes an empty cartridge magazine to a full one during the battle. The empty cartridge magazines may be changed to full cartridge magazines during pauses in the battle. The cartridge magazines are then filled by the soldier or by separate persons behind the battle lines. Another possibility is that the soldier fills his empty cartridge magazines during pauses in the battle.

U.S. Pat. No. 3,789,531 discloses methods and devices for packing and loading ammunition. The patent discloses an ammunition container, in particular for small arms, such as rifles, sub-machine guns and machine guns. The ammunition container combines features adapted for protective packaging and for loading the ammunition into magazines or the like. The container is usually made of plastic and is disposable. It eliminates special loading funnels for weapons which required such loading funnels for loading the magazines. Some embodiments are waterproof by a plastic foil. Those embodiments which are designed for transferring the ammunition from the package into a magazine comprises formations which either fit around the outside or into the inside of the magazine for proper alignment. Luminous indicating means may be provided to facilitate loading in the dark. The containers can be made so that they will float on water.

U.S. Pat. No. 4,352,254 discloses a cartridge package for rapid loading of a magazine or clip for automatic or semi-automatic weapons. The package for cartridges comprises a generally U-shaped frame whose shanks form inwardly open channels receiving opposite ends of the cartridge rounds. The mouth of the package is formed with a substantially funnel-shaped seat adapted to surmount the mouth of the magazine or clip so that the stack of cartridge can be pressed from its side opposite the mouth into the magazine, e.g. by insertion of fingers through windows defined in the shanks. The seat is asymmetrical with respect to the median plane through the package with side of the seat being formed with openings opposite the aprons which define the funnel shape.

US patent publication 2012/0255211 discloses systems and methods for receiving and loading cartridges in bulk. A device includes multiple parallel partition walls configured to couple with cartridge carriers and segregate, group and single file line the cartridges removed from the cartridge carriers and placed onto a receiving surface. An alignment wall on the receiving surface works in conjunction with the partition walls in aligning groups of cartridges into single files on the receiving surface. A on the receiving surface sliding loading rod urges single filed groups of cartridges from the receiving surface into a magazine coupled with the receiving surface.

These prior art solutions disclose a cartridge package being provided with windows through which fingers can be inserted into the package in order to push the cartridges within the cartridge package from the cartridge package into the cartridge magazine. The use of fingers to push the cartridges will very soon result in fatigue in the fingers. It might even be impossible to the push the cartridges with the fingers in harsh weather conditions i.e. below zero temperatures. It might not even be possible for an ordinary person to press the cartridges of a bigger caliber e.g. 7.62 NATO weapon from the cartridge package to the cartridge magazine due to the great spring force used in the cartridge magazine.

SUMMARY

An object of the present invention is to achieve an improved cartridge package.

The cartridge package according to the invention is defined in claim 1.

The cartridge package comprises:

an elongated housing having two opposite side walls, two opposite edge walls connecting the longitudinal edges of the side walls, a bottom end, a top end opposite to the bottom end, and a first compartment being formed in an interior of the housing, the first compartment being divided into two sub-compartments with a longitudinal flexible intermediate wall, a first sub-compartment being formed between the intermediate wall and the first side wall, and a second sub-compartment being formed between the intermediate wall and the second side wall, each sub-compartment being filled with one row of cartridges, each of the side walls being provided with a longitudinal slot providing access into a respective sub-compartment, a mouth portion extending outwards in the longitudinal direction from the top end of the housing, a second compartment being formed within the mouth portion, the first sub-compartment and the second sub-compartment opening into the second compartment at the top end of the housing, the second compartment having an open top end and being adapted to receive a mouth portion of a first cartridge magazine in order to load the cartridges from the cartridge package into the first cartridge magazine, whereby the width of the longitudinal slots is dimensioned according to a thickness of the cartridge magazine so that an edge of a second cartridge magazine can be inserted into the respective longitudinal slot in order to push the respective row of cartridges from the cartridge package into the first cartridge magazine.

The second cartridge magazine can be held firmly in the hand of the user when the cartridges are pushed from the cartridge package to the cartridge magazine. This will eliminate the problem with fatigue in the fingers. This will also make it possible for an ordinary person to push the cartridges of a bigger caliber e.g. 7.62 NATO weapon from the cartridge package to the cartridge magazine even if spring force used in the cartridge magazine is great.

The cartridges in the cartridge package can be pushed very fast i.e. within less than 20 seconds or even less than 10 seconds into the cartridge magazine compared to a normal loading procedure in which one cartridge is loaded at a time, whereby said normal loading procedure may take over one minute per cartridge magazine. The amount of cartridges in a cartridge package may correspond to the amount of cartridges in the cartridge magazine. This amount of cartridges may be e.g. in the range of 20 to 40 cartridges in a modern automated or semi-automated weapon.

The cartridge package may be a cheap disposable cartridge package for cartridges. The cartridge package may be made of any durable and weatherproof material e.g. plastic. The cartridge packages may instead of being disposable be refilled and reused if there is a need for this.

There is no need to have special guiding means in the sub-compartments for the bullet and the base of the cartridge. The cartridges will be kept in place between the smooth surfaces of the sub-compartments.

The size of the cartridge package may be optimized so that a maximum number of cartridge packages may be fitted in a greater cartridge box.

DRAWINGS

Figure 2:
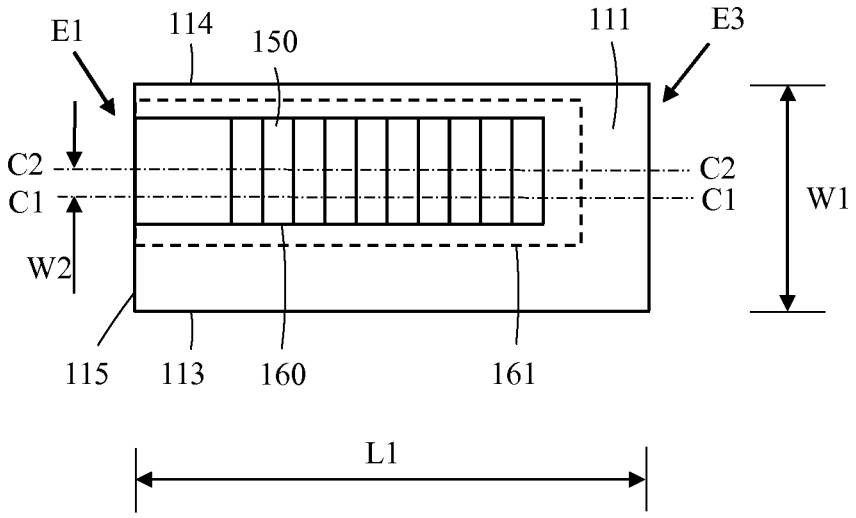
Figure 3:
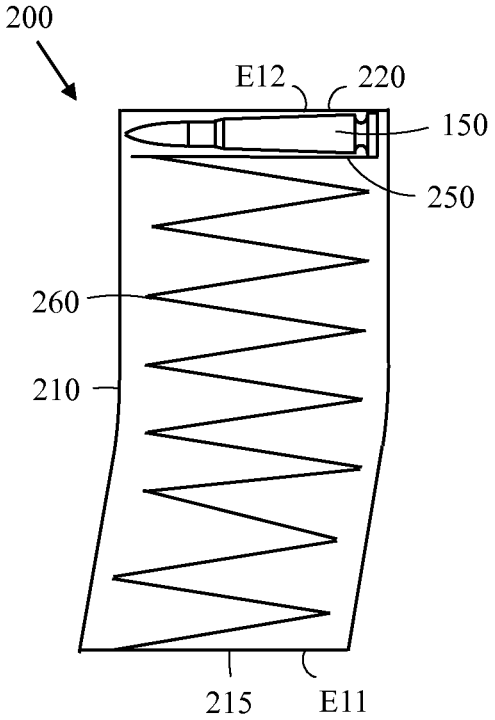
Figure 4:
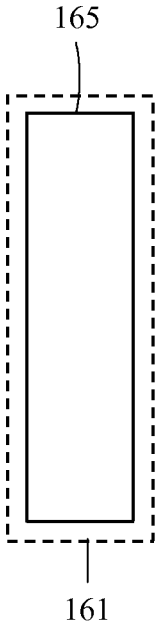
Figure 5:
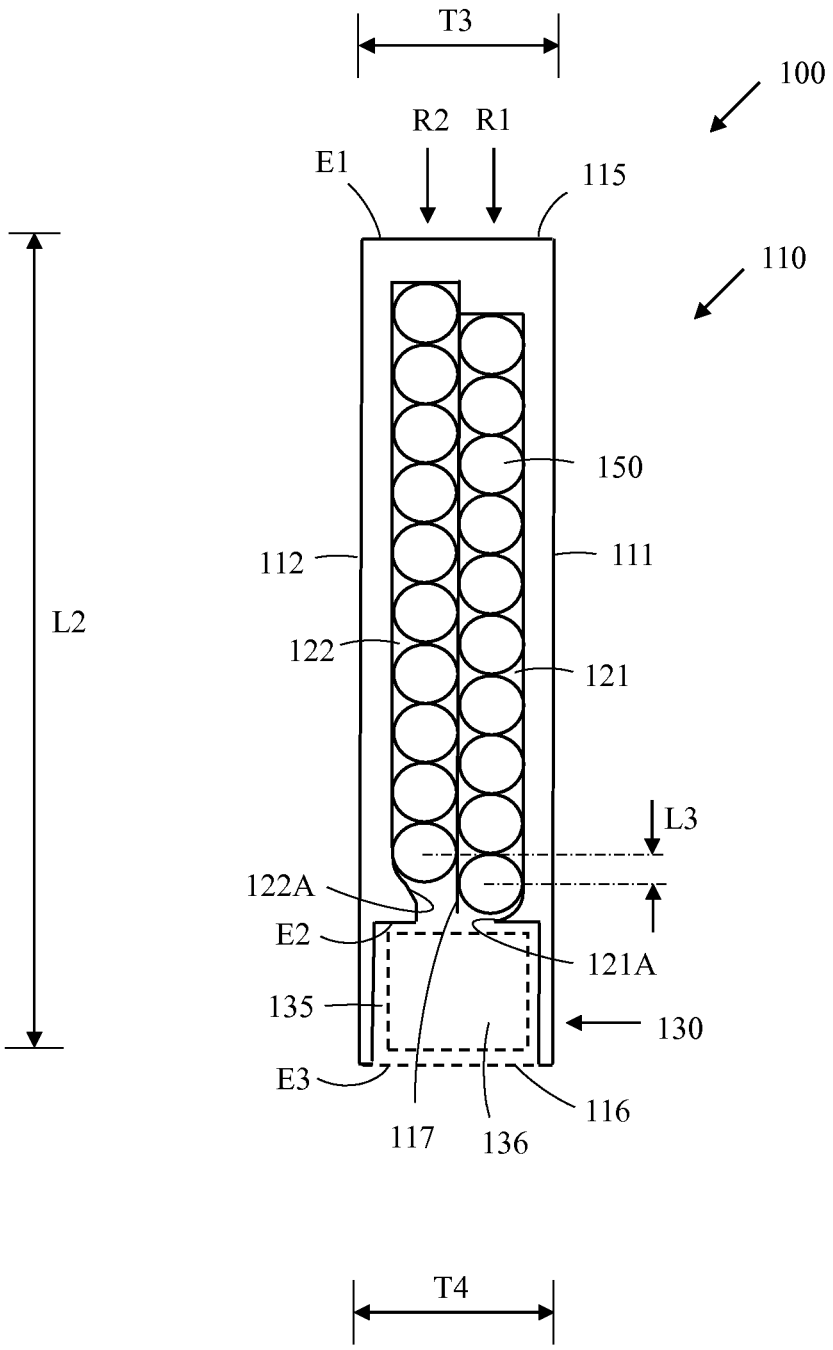
Figure 6:
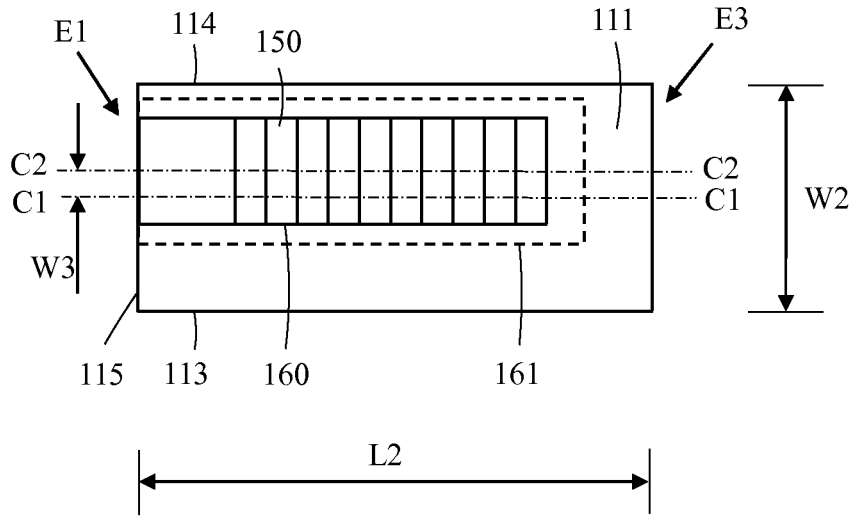
Figure 7:
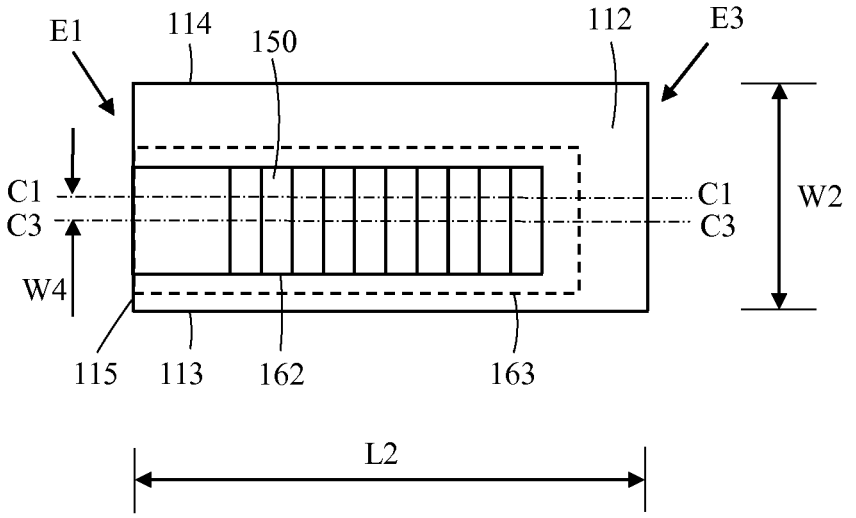
Figure 8:
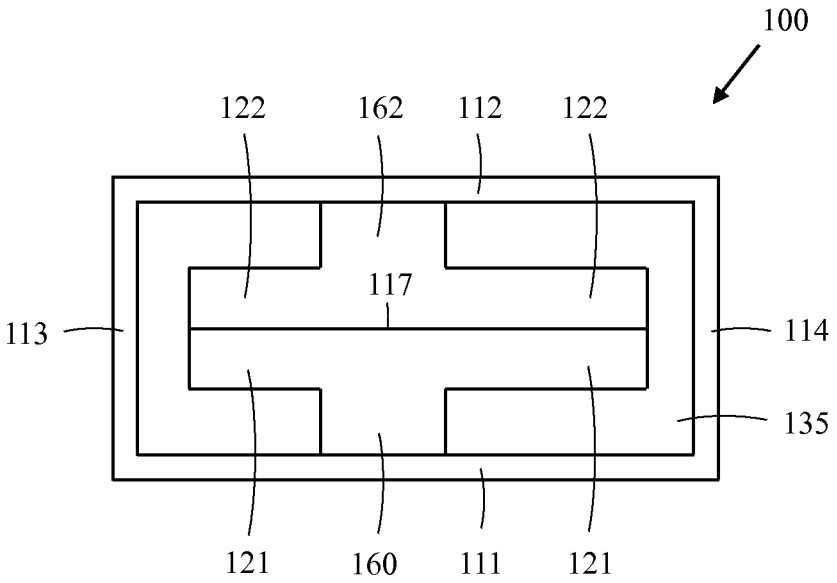
Figure 9:
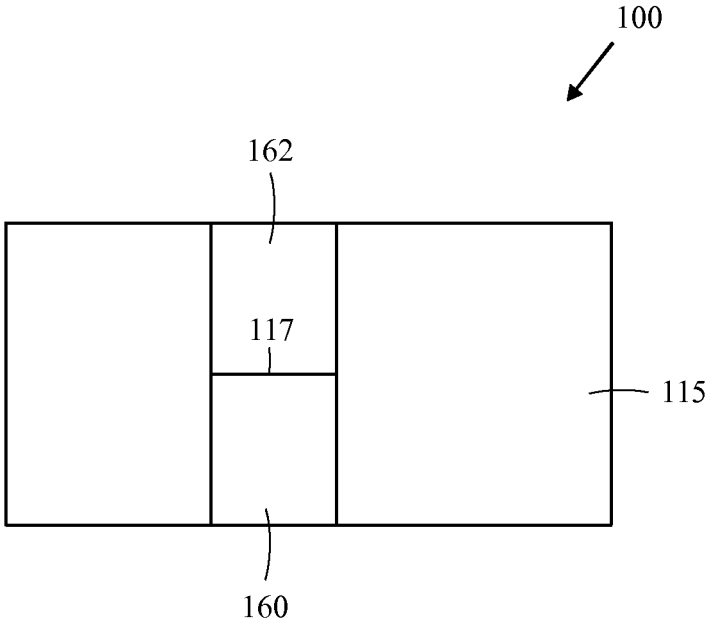
Figure 10:
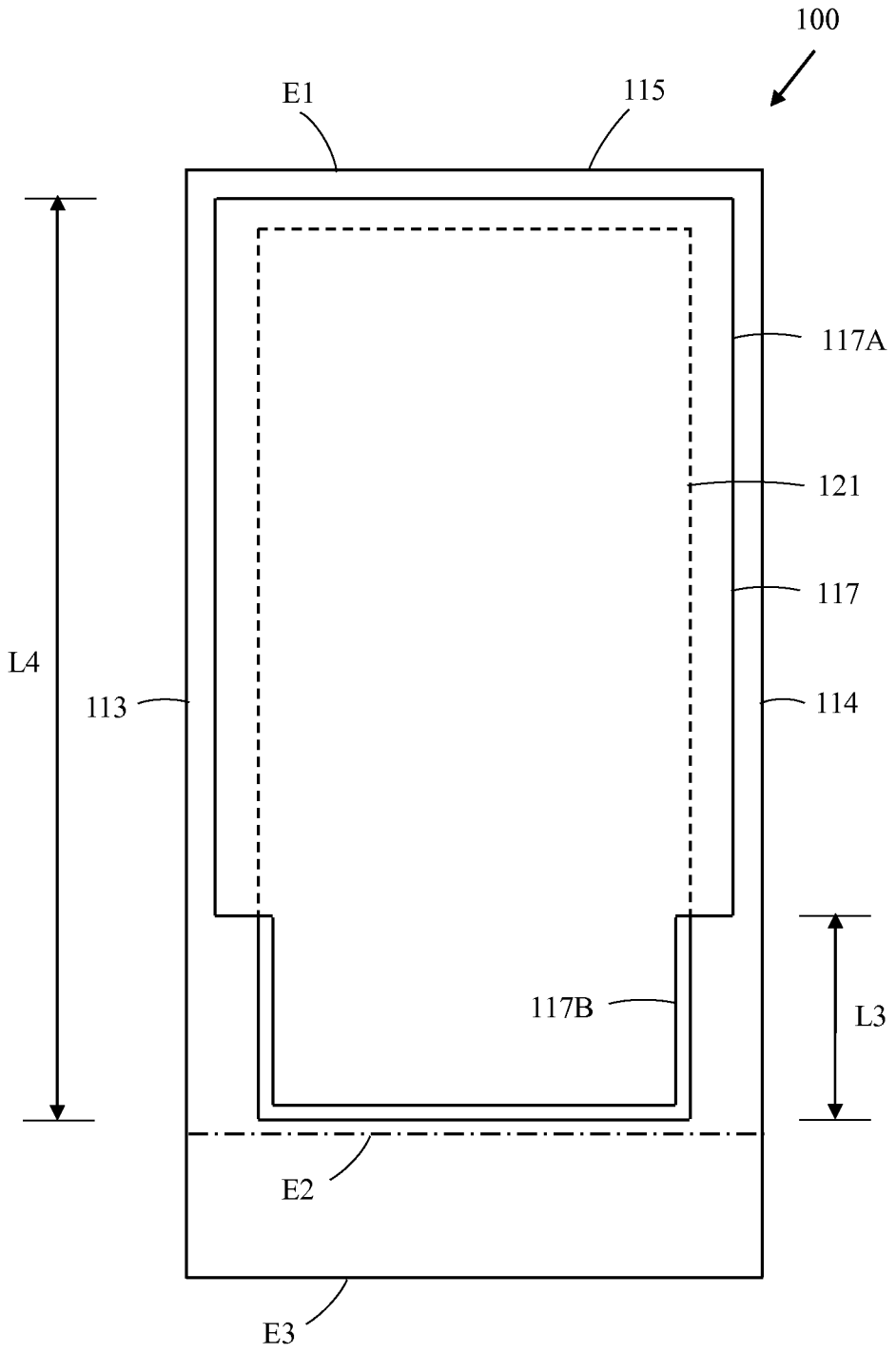

In the following the invention will be described in greater detail by means of preferred embodiments with reference to the attached drawings, in which FIG. 1 shows a cross sectional view of a cartridge package, FIG. 2 shows a side view of the cartridge package of FIG. 1, FIG. 3 shows a cross sectional view of a cartridge magazine, FIG. 4 shows a view of a strip to be used with a cartridge package, FIG. 5 shows a cross sectional view of a cartridge package according to the invention, FIG. 6 shows a first side view of the cartridge package of FIG. 5, FIG. 7 shows second opposite side view of the cartridge package of FIG. 5, FIG. 8 shows a top view of the cartridge package of FIG. 5, FIG. 9 shows a bottom view of the cartridge package of FIG. 5, FIG. 10 shows a cross sectional view of the cartridge package of FIG. 5.

DETAILED DESCRIPTION

FIG. 1 shows a cross sectional view of a cartridge package and FIG. 2 shows a side view of the cartridge package of FIG. 1.

The cartridge package 100 shown in FIGS. 1 and 2 accommodating only one row R1 of cartridges 150 is not within the scope of the claims.

The cartridge package 100 comprises an elongated housing 110 having a length L1, a width W1, and a thickness T1, T2. The housing 110 comprises two opposite side walls 111, 112, two edge walls 113, 114 connecting the longitudinal opposite edges of the side walls 111, 112. A bottom end E1 of the housing 110 may comprise a bottom wall 115. The bottom wall 115 may close a part of the bottom end E1. A top end E2 of the housing 110 is formed at an opposite end of the housing 110 in relation to the bottom end E1. The top end E2 of the housing 110 may be open. A first compartment 120 receiving a row R1 of cartridges 150 is formed in the interior of the housing 110.

The longitudinal direction of the cartridges 150 is directed along the width W1 of the housing 110. The width of the first compartment 120 within the housing 110 may be dimensioned according to the length of the cartridges 150. The thickness of the first compartment 120 within the housing 10 may be dimensioned according to the thickness i.e. the maximum diameter of the cartridges 150. The length of the first compartment 120 within the housing 110 may be dimensioned according to the amount of cartridges 150 that are to be accommodated in the cartridge package 100. The figure shows only ten cartridges 150 in the cartridge package 100, but the cartridge package 100 can be dimensioned for any number of cartridges 150. The cartridge package 100 may be dimensioned according to the capacity of the cartridge magazine and may contain e.g. twenty to forty cartridges 150.

The housing 110 may have a general form of a parallelepiped, which means that the side walls 111, 112 or at least the outer surfaces of the side walls 111, 112 of the housing 110 may be parallel. The first compartment 120 within the housing 110 may also be formed as a parallelepiped, but this need not be the case. A cartridge 150 is normally conical so that the diameter of the base end of the cartridge 150 is greater than the diameter of the shoulder of the cartridge 150. This means that the first compartment 120 could also be conical in a corresponding way. The base end of the cartridge 150 would be in the thicker portion of the first compartment 120 and the bullet end of the cartridge 150 would be in the thinner portion of the first compartment 120. The side walls 111, 112 of the housing 110 are advantageously planar, but they could be provided with e.g. slightly corrugated surfaces. The edge walls 113, 114 are also advantageously parallel, but they could also be non-parallel. The edge walls 113, 114 are advantageously planar, but they could be provided with e.g. slightly corrugated surfaces or they could e.g. be curved inwardly or outwardly. A parallelepiped is the most advantageous form in view of the manufacturing and the storage of the cartridge package 100.

The first compartment 120 may be provided with a holding stud or holding protrusion or some other holding means 125 positioned at the top end E2 of the housing 110. The holding means 125 may be positioned at the outer side of the outermost cartridge 150 and protrudes into the first compartment 120 from the wall surface of the first compartment 120. The holding means 125 will form a stop for the outermost cartridge 150 so that the row of cartridges 150 cannot accidentally fall out from the first compartment 120. The holding means 125 may be e.g. spring loaded so that the holding means 125 can be pressed downwards into the wall of the housing 110 when the row of cartridges 150 are pressed in order to push the row of cartridges 150 out of the housing 110. The holding means 125 may be positioned in a tight hole. The holding means 125 moves in the hole when the force acting on the holding means 125 exceeds the friction in the hole. The holding means 125 will thus remain in a contracted state once it has been pushed into the hole leaving the passage free for the row R1 of cartridges 150.

The first side wall 111 of the housing 110 is provided with a first slot 160 extending along the longitudinal direction of the housing 110. The first slot 160 may extend from the top end E2 of the housing 110 until the bottom end E1 of the housing. The first slot 160 may further be open in the bottom wall 115 of the housing 110 so that access to the innermost cartridge 150 in the row R1 of cartridges 150 is provided through the bottom wall 115 of the housing 110. The first slot 160 may be closed with a removable first strip 161. The removal of the first strip 161 opens the first slot 160 and provides access into the first compartment 120 in the interior of the housing 110. The first slot 160 extends along the length of the housing 110, whereby a portion of the length of the cartridges 150 is revealed through the first slot 160. The longitudinal centre line C2-C2 of the first slot 160 is at a distance W2 from the longitudinal centre line C1-C1 of housing 110. The longitudinal centre line C2-C2 of the first slot 160 is thus offset towards the base end of the cartridge 150 in relation to the longitudinal middle point of the cartridge 150. The cartridges 150 are conically contracting from the base end towards the bullet end of the cartridge 150. It is thus advantageous to have the first slot 160 offset from the longitudinal middle point of the cartridges 150. The first slot 160 in the first side wall 111 is used to push out the row R1 of cartridges 150 from the cartridge package 100. The first strip 161 may be in the form of a foil.

The cartridge package 110 comprises further a mouth portion 130 extending outwards in the longitudinal direction from the top end E2 of the housing 110. The mouth portion 130 may be straight or funnel-shaped or cone shaped or tapered and adapted to receive a mouth portion 220 of a first cartridge magazine 200 in order to load the cartridges 150 from the cartridge package 100 into the first cartridge magazine 200. The mouth portion 130 comprises a second compartment 135 into which a first cartridge magazine 200 may be pushed from the open outer end E3 of the second compartment 135. The first compartment 120 opens into the second compartment 135 at the top end E2 of the housing 110. The top end E2 of the housing 110 forms a step within a bottom of the second housing 135 against which the top end E12 of the first cartridge magazine 200 seats when the cartridge magazine 200 is pushed into the second compartment 135 in the mouth portion 130. The outer surface of the second side wall 112 is planar until the end of the mouth portion 130. The thickness of the second side wall 112 is, however, smaller at the second compartment 135 compared to the thickness of the second side wall 112 at the first compartment 120. The outer surface of the first side wall 111 is planar at the first compartment 120. The first side wall 111 comprises a transverse portion 111A followed by a longitudinal portion 111B at the second compartment 135. The thickness of the first side wall 111 is approximately uniform in all portions of the first side wall 111. A step is thus formed in the transition between the first compartment 120 and the second compartment 130 at the first side wall 111. The second compartment 135 is thus wider in the thickness direction of the cartridge package 100 compared to the first compartment 120 in order to be able to receive the first cartridge magazine 200.

A removable strip 116 may be provided for closing the open outer end E3 of the mouth portion 130 of the housing 110. A soft pad 136 may be positioned in the second compartment 135 in the mouth portion 130 when the cartridge package 100 has been filled with cartridges 150. The removable strip 116 will keep the third soft pad 136 in place in the second compartment 135. The soft pad 136 will secure that the cartridges 150 remain in place in the first compartment 120 during the storage and the transport of the cartridge package 100. The soft pad 136 may be attached to the strip 116 so that the soft pad 136 is removed when the strip 116 is removed. A single removable strip may instead of two separate strips 116, 161 be used to close the opening in the mouth portion 130 and the longitudinal slot 160.

The width of the first slot 160 in the longitudinal direction of the cartridge package 100 is dimensioned according to the thickness of the cartridge magazine 200. An edge of a second cartridge magazine 200 can be pushed through the first slot 160 into the first compartment 120 in the first housing 110 in order to push the cartridges 150 in the row R1 of cartridges 150 in the cartridge package 100 from the cartridge package 100 into the first cartridge magazine 200.

FIG. 3 shows a cross sectional view of a cartridge magazine.

The cartridge magazine 200 comprises an elongated straight or slightly curved housing 210. The cartridge magazine has a bottom end E11 being closed with a bottom wall 215. A top end E12 of the housing 210 is formed at an opposite end of the housing 210 in relation to the bottom end E11 of the housing 210. The top end E12 of the housing 210 forms a mouth portion of the cartridge magazine 200. An interior of the housing 210 forms a compartment for cartridges 150. The housing is shown with only one cartridge 150. The cartridge magazine 200 comprises further feeding means positioned inside the housing 210. The feeding means may comprise a support plate 250 being movably arranged within the housing 210. The support plate 250 may be loaded with loading means e.g. with spring means 260. The loading means 260 presses the support plate 250 towards the mouth portion 220 of the housing 210 so that the uppermost cartridge 150 is pressed against the top end E12 of the cartridge magazine 200. The cartridges 150 are inserted into the housing 210 from an opening in the mouth portion 220 of the cartridge magazine 200. The support plate 250 moves downwards towards the bottom 215 of the housing 210 against the force of the loading means 260 when the housing 210 is loaded with cartridges 150. The support plate 250 will be in an innermost position near the bottom 215 of the housing 210 when the housing 210 is full with cartridges 150.

The mouth portion 220 of the cartridge magazine 200 can be pushed into the mouth portion 130 of the cartridge package 100. The mouth portion 130 of the cartridge package 100 will receive the mouth portion 220 of the cartridge magazine 200 so that the top end E12 of the cartridge magazine 200 becomes seated against the top end E2 of the housing 110 of the cartridge package 100. The amount of cartridges 150 in the cartridge package 100 is advantageously the same as the capacity in the cartridge magazine 200. One cartridge magazines 200 can thus be filled with the content of one cartridge package 100.

FIG. 4 shows a view of a strip to be used with a cartridge package.

The first strip 161 may be provided with a first soft pad 165 attached to the inner surface of the first strip 161 so that the first soft pad 165 is pushed through the first slot 160 into contact with the cartridges 150 when the first strip 161 is attached to the housing 100. The first pad 165 is normally not needed, but it might in some cases help to keep the cartridges 150 in place during storage and transportation of the cartridge package 100. The first soft pad 165 would be removed with the first strip 161 when the first strip 161 is removed from the cartridge package 100.

FIG. 5 shows a cross sectional view of a cartridge package according to the invention, FIG. 6 shows a first side view of the cartridge package of FIG. 5, and FIG. 7 shows a second opposite side view of the cartridge package of FIG. 5.

The cartridge package 100 according to the invention comprises an elongated housing 110 having a length L2, a width W2, and a thickness T3, T4. The housing 110 comprises two opposite side walls 111, 112, two edge walls 113, 114 connecting the longitudinal opposite edges of the side walls 111, 112. A bottom end E1 of the housing 110 may comprise a bottom wall 115. The bottom wall 115 may close a part of the bottom end E1 of the housing 110. A top end E2 of the housing 110 is formed at an opposite end of the housing 110 in relation to the bottom end E1. The top end E2 may be open. This cartridge package 100 is designed for two parallel rows R1, R2 of cartridges 150. The interior of the cartridge package 100 is divided into two sub-compartments 121, 122 with an intermediate wall 117. The intermediate wall 117 may be parallel with the two side walls 111, 112. A first sub-compartment 121 is formed between the intermediate wall 117 and the first side wall 111. A second sub-compartment 122 is formed between the intermediate wall 117 and the second side wall 112. The first sub-compartment 121 is filled with a first row R1 of cartridges 150 and the second sub-compartment 122 is filled with a second row R2 of cartridges 150. The intermediate wall 117 is of a flexible material so that the lower end of the intermediate wall 117 can bend slightly to the left in FIG. 5 when the cartridges 150 in the first row R1 are pressed out from the first sub-compartment 121. The first row R1 of cartridges 150 has to be pressed out from the first sub-compartment 121 in the cartridge package 100 first. The second row R2 of cartridges 150 can be pressed out from the second sub-compartment 122 in the cartridge package 100 after that. The first sub-compartment 121 has an inwardly curved wall portion 121A when opening into the second compartment 135 so that the cartridges 150 are directed from the first sub-compartment 121 to the middle of the second compartment 135 when they are pushed out from the first sub-compartment 121. The second sub-compartment 122 has also an inwardly directed wall portion 122A when opening into the second compartment 135 so that the cartridges 150 are directed from the second sub-compartment 122 to the middle of the second compartment 135 when they are pushed out from the second sub-compartment 122.

The first row R1 of cartridges 150 and the second row R2 of cartridges 150 are staggered L3 so that the outermost cartridge 150 at the top end E2 of the housing 110 in the second row R2 of cartridges 150 is positioned farther from the top end E2 of the housing 110 compared to the outermost cartridge 150 at the top end E2 in the first row R1 of cartridges 150. The length L3 of the staggering in the longitudinal direction of the housing 110 may be equal to largest diameter of the cartridges 150.

The first side wall 111 of the housing 110 of the cartridge package 100 is in the same way as in the cartridge package 100 shown in FIGS. 1 and 2 provided with a first slot 160 extending along the longitudinal direction of the housing 110. The first slot 160 may extend from the top end E2 of the housing 110 to the bottom end E1 of the housing 110. The bottom wall 115 may provide an opening to the first slot 160. The longitudinal centre line C2-C2 of the first slot 160 is at a distance W3 from the longitudinal centre line C1-C1 of the housing 110. This means that the first slot 160 reveals a portion of the length of the cartridges 150 that is near the base end of the cartridges 150. The cartridges 150 are conically contracting from the base end towards the bullet end of the cartridge 150. It is thus advantageous to have the first slot 160 offset towards the base end of the cartridge 150 from the longitudinal middle point of the cartridges 150. The first slot 160 in the first side wall 111 is used to push out the first row R1 of cartridges 150 from the cartridge package 100.

The first slot 160 may be closed with a first strip 161. The removal of the first strip 161 opens the first slot 160 and provides access into the first sub-compartment 121 in the housing 110. The first strip 161 may be in the form of a foil.

There may be a first soft pad 165 attached to the inner surface of the first strip 161 so that the first soft pad 165 is pushed through the first slot 160 into contact with the cartridges 150 when the first strip 161 is attached to the outer surface of the first side wall 111. Such a first soft pad 165 is not normally needed, but it might in some circumstances help to keep the cartridges 150 in place during storage and transportation of the cartridge package 100. The first soft pad 165 would be removed with the first strip 161 when the first strip 161 is removed from the housing 110. The first soft pad 165 may be equivalent to the soft pad 165 used in the first embodiment of the cartridge package shown in FIG. 4.

The second side wall 112 is provided with a second slot 162 extending in the longitudinal direction of the housing 110. The second slot 162 may extend from the top end E2 of the housing 110 to the bottom end E1 of the housing 110. The bottom wall 115 may provide an opening to the second slot 162. The longitudinal centre line C3-C3 of the second slot 162 is at a distance W4 from the longitudinal centre line C1-C1 of housing 110. This means that the second slot 162 reveals a longitudinal portion of the cartridges 150 that is near the base end of the cartridges 150. The cartridges 150 are conically contracting from the base end towards the bullet end of the cartridge 150. It is thus advantageous to have the second slot 162 offset towards the base end of the cartridge 150 from the longitudinal middle point of the cartridges 150. The second slot 162 in the second side wall 112 is used to push out the second row R2 of cartridges 150 from the cartridge package 100.

The second slot 162 may be closed with a second strip 163. The removal of the second strip 163 opens the second slot 162 and provides access into the second sub-compartment in the housing 110. The second strip 163 may be formed of a foil.

There may be a second soft pad attached to the inner surface of the second strip 163 so that the second soft pad is pushed through the second slot 162 into contact with the cartridges 150 when the second strip 163 is attached to the outer surface of the first side wall 112. Such a second soft pad 165 is not normally needed, but it might in some circumstances help to keep the cartridges 150 in place during storage and transportation of the cartridge package 100. The second soft pad would be removed with the second strip 163 when the second strip 163 is removed from the housing 110. The second soft pad may be equivalent to the soft pad 165 used in the first embodiment of the cartridge package shown in FIG. 4.

The first strip 161 and the second strip 163 may be formed of a single strip closing the first slot 160 and the second slot 162. The single strip will thus extend on both sides of the cartridge package 100.

The width of the first slot 160 in the longitudinal direction of the cartridge 150 and the width of the second slot 162 in the longitudinal direction of the cartridge 150 is dimensioned according to the thickness of the cartridge magazine 200. The edge of a second cartridge magazine 200 can be pushed first into the first slot 160 and then into the second slot 162 in order to push the respective row R1, R2 of cartridges 150 in the cartridge package 100 from the cartridge package 100 into the first cartridge magazine 200. The cartridges 150 in the first sub-compartment 121 may be pushed first into the first cartridge magazine 200 and the cartridges 150 in the second sub-compartment 122 may after that be pushed into the same first cartridge magazine 200.

The cartridge package 110 comprises further a mouth portion 130 extending outwards in the longitudinal direction from the top end E2 of the housing 110. The mouth portion 130 corresponds to the mouth portion 130 in the cartridge package 100 shown in FIGS. 1 and 2 and may be straight or funnel-shaped or cone shaped or tapered and adapted to receive a mouth portion 220 of a first cartridge magazine 200 in order to load the cartridges 150 from the cartridge package 100 into the first cartridge magazine 200. The mouth portion 130 comprises a second compartment 135 into which a first cartridge magazine 200 may be pushed from the open outer end E3 of the second compartment 135. The top end E2 of the housing 110 forms a step against which the top end E12 of the first cartridge magazine 200 seats when the cartridge magazine 200 is pushed into the second compartment 135 in the mouth portion 130. The outer surface of the first side wall 111 and the outer surface of the second side wall 112 is planar from the bottom end E1 of the cartridge package 100 to the outer end E3 of the cartridge package 100. The thickness T3 of the cartridge package 100 at the bottom end E1 of the cartridge package 100 is the same as the thickness T4 of the cartridge package 100 at the top end E3 of the cartridge package 100. The thickness of the side walls 111, 112 is, however, smaller at the second compartment 135. This means that the second compartment 135 is wider in the direction of the thickness T3, T4 of the cartridge package 100 compared to the first compartment 120.

The mouth portion 220 of the cartridge magazine 200 can in the same way as in the cartridge package 100 of FIG. 1 be pushed into the mouth portion 130 of the cartridge package 100. The mouth portion 130 of the cartridge package 100 will receive the mouth portion 220 of the cartridge magazine 200 so that the top end E12 of the cartridge magazine 200 becomes seated against the top end E2 of the housing 110 of the cartridge package 100. The amount of cartridges 150 in the first row R1 may be the same as the amount of cartridges 150 in the second row R2. The amount of cartridges 150 in the first row R1 plus the amount of cartridges 150 in the second row R2 may be the same as the capacity in the cartridge magazine 200.

FIG. 8 shows a top view of the cartridge package of FIG. 5. The top view is from the mouth portion 130 of the cartridge package 100. The second compartment 135 in the mouth portion 130 of the cartridge package 100 extends to the top end E2 of the housing 110. The first sub-compartment 121 and the second sub-compartment 122 start at the top end E2 of the housing 110. The first sub-compartment 121 and the second sub-compartment 122 are separated by the intermediate wall 117. The slots 160, 162 extend between the respective sub-compartment 121, 122 and the side walls 111, 112. The slots 160, 162 open into the outer surface of the side walls 121, 122 along the length of the housing 110.

FIG. 9 shows a bottom view of the cartridge package of FIG. 5. The slots 160, 162 may open into the bottom wall 115 so that they form a rectangular opening in the bottom wall 115 providing access to each sub-compartment 121, 122 in the housing 110. The intermediate wall 117 may start from the inner surface of the bottom wall 115 and extends to the top end E2 of the housing 110.

FIG. 10 shows a cross sectional view of the cartridge package of FIG. 5. The cartridge package 100 may be manufactured of two halves that are attached to each other. The figure shows a first half of the cartridge package 100. The figure shows the longitudinal edge walls 113, 114, the bottom end E1 provided with the bottom wall 115, to top end E2, the outer end E3 of the first half of the cartridge package 100, and the first sub-compartment 121 in the first half of the cartridge package 100. The intermediate wall 117 is positioned on the first compartment 121. The second half of the cartridge package 100 will comprise the second sub-compartment 122. The division line between the first half and the second half of the cartridge package 100 may thus extend along the plane of the intermediate wall 117. A first row R1 of cartridges 150 may be positioned in the first sub-compartment 121 and a second row of cartridges 150 may be positioned in the second sub-compartment 122. An upper portion 115A of the intermediate wall 117 may be wider than the first sub-compartment 121 and a lower portion of the intermediate wall 117 may be slightly narrower than the first sub-compartment 121. The outer edges of the upper portion 117A of the intermediate wall 117 will thus be pressed between the outer edges of the first half and the second half of the cartridge package 100 when said halves are fixed to each other to form the complete cartridge package 100. The lower portion 117B of the intermediate wall 117 will on the other hand be free. The flexibility of at least the lower portion 117B of the intermediate wall 117 will ensure that the lower portion 117B of the intermediate wall 117 can be bent within the sub-compartments 121, 122 when a force is applied in the side direction to the lower portion 117B of the intermediate wall 117. The two rows R1, R2 of cartridges 150 can thus be pressed out from the cartridge package 100 as explained in connection with FIG. 5. The length L3 in the longitudinal direction of the lower portion 117B of the intermediate wall 117 may be a portion of the total length L4 of the intermediate wall 117. The portion may be in the range of 5 to 40 % of the total length L4 of the intermediate wall 117. The lower half and the upper half of the cartridge package 100 may be attached to each other by any fastening means suitable for the purpose. The fastening means may be based on e.g. glue and/or screws and/or plugs and/or snap fastening means.

The longitudinal slots 160, 162 may extend through the bottom end E1 of the cartridge package 100 so that the cartridge magazine that is used for pushing the rows R1, R2 of cartridges 150 from the cartridge package 100 to the cartridge magazine 200 can be positioned upon the innermost cartridge 150 in the cartridge package 100. The innermost cartridge 150 is the cartridge positioned closest to the bottom end El of the cartridge package 100. The whole row R1, R2 of cartridges 150 can thus be pushed from the cartridge package 100 with one continuous push to the cartridge magazine 200.

No holding means 125 are needed in the cartridge package 100 of FIG. 5. The first row R1 of cartridges 150 will be held in place by the flexible intermediate wall 117 i.e. a certain force is needed in order to bend the intermediate wall 117 to the left in the FIG. 5 so that the cartridges 150 can pass from the first sub-compartment 121 to the second compartment 135.

The length L2 of the cartridge package 100 of FIG. 5 is smaller compared to the length L1 of the cartridge package 100 of FIG. 1 in a case where there are the same amount of cartridges 150 in both cartridge packages 100. The thickness T3 of the housing 110 in the cartridge package 100 of FIG. 5 is greater compared to the thickness T1 of the housing 110 of the cartridge package 100 of FIG. 1. The thickness T2, T4 of the mouth portion 130 is, however, approximately the same in the cartridge package 100 of FIG. 1 and FIG. 5.

The cartridges 150 in the first row R1 and in the second row R2 in the cartridge package 100 may be directed in the same direction. This means that there is no need to detach the cartridge magazine 200 from the cartridge package 100 after the first row R1 of cartridges 150 has been pushed from the cartridge package 100 to the cartridge magazine 200. The second row R2 of cartridges 150 can be pushed to the cartridge magazine 200 immediately after the first row R1 of cartridges 150 has been pushed into the cartridge magazine 200 by moving the cartridge magazine 200 from the first side of the cartridge package 100 to the second opposite side of the cartridge package 100.

A single strip may be used instead of separate strips in order to close the mouth portion 130 and the slots 160, 162 in the cartridge package 100. The single strip may extend around the whole cartridge package 100. The soft pad 136 to be positioned in the second compartment 135 in the mouth portion 130 of the cartridge package 100 may be attached to the single strip so that the removal of the single strip removes the soft pad 136. In case soft pads are also used in the slots 160, 162, then also these soft pads may be attached to the single strip so that they are removed when the single strip is removed.

There might not be any need to use one or more strips 161, 163 in order to close the mouth portion 130 and the slots 160, 162 of the cartridge package 100 in a situation in which the cartridge package 100 is enclosed in a separate outer package. The outer package will in such case enclose the whole cartridge package 100. The soft pad 136 to be positioned in the second compartment 135 in the mouth portion 130 may in such case be attached to the outer package. The outer package may be of cardboard or of plastic.

It will be obvious to a person skilled in the art that, as the technology advances, the inventive concept can be implemented in various ways. The invention and its embodiments are not limited to the examples described above but may vary within the scope of the claims.

The invention claimed is:

1. A cartridge package (100) comprising:

an elongated housing (110) having two opposite side walls (111, 112), two opposite edge walls (113, 114) connecting the longitudinal edges of the side walls (111, 112), a bottom end (E1), a top end (E2) opposite to the bottom end (E1), and a first compartment (120) being formed in an interior of the housing (110), the first compartment (120) being divided into two sub-compartments (121, 122) with a longitudinal flexible intermediate wall (117), a first sub-compartment (121) being formed between the intermediate wall (117) and the first side wall (111), and a second sub-compartment (122) being formed between the intermediate wall (117) and the second side wall (112), each sub-compartment (121, 122) being filled with one row (R1, R2) of cartridges (150), each of the side walls (111, 112) being provided with a longitudinal slot (160, 162) providing access into a respective sub-compartment (121, 122), a mouth portion (130) extending outwards in the longitudinal direction from the top end (E2) of the housing (110), a second compartment (135) being formed within the mouth portion (130), the first sub-compartment (121) and the second sub-compartment (122) opening into the second compartment (135) at the top end (E2) of the housing (110), the second compartment (135) having an open top end (E3) and being adapted to receive a mouth portion (220) of a first cartridge magazine (200) in order to load the cartridges (150) from the cartridge package (100) into the first cartridge magazine (200), whereby the width of the longitudinal slots (160, 162) is dimensioned according to a thickness of the cartridge magazine (200) so that an edge of a second cartridge magazine (200) can be inserted into the respective longitudinal slot (160, 162) in order to push the respective row (R1, R2) of cartridges (150) from the cartridge package (100) into the first cartridge magazine (200).

2. The cartridge package (100) according to claim 1, characterized in that a longitudinal centre line (C2-C2, C3-C3) of the longitudinal slot (160, 162) at each side wall (111, 112) is at a distance (W3, W4) from a longitudinal centre line (C1-C1) of the respective side wall (111, 112), whereby the longitudinal centre line (C2-C2, C3-C3) is offset towards a base end of the cartridge (150) in relation to a longitudinal middle point of the cartridge (150).

3. The cartridge package (100) according to claim 1, characterized in that a soft pad (136) is inserted into the second compartment (135) in order to keep the rows (R1, R2) of cartridges (150) in place in the respective sub-compartment (121, 122) during storage and transportation of the cartridge package (100).

4. The cartridge package (100) according to claim 1, characterized in that the top end (E3) of the mouth portion (130) of the cartridge package (100) is closed with a removable strip (116).

5. The cartridge package (100) according to claim 1, characterized in that each longitudinal slot (160, 162) is closed with a removable strip (161, 163), whereby separate strips or a single strip may be used to close the top end (E3) of the mouth portion (130) and the longitudinal slots (160, 162).

6. The cartridge package (100) according to claim 1, characterized in that the cartridge package (100) is made of a durable and weatherproof material.

7. The cartridge package (100) according to claim 1, characterized in that the first sub-compartment (121) comprises a curved portion (121A) at the top end (E2) of the housing (110) directing the first row (R1) of cartridges (150) towards the middle of the second compartment (135) in the mouth portion (130) of the cartridge package (100), whereby the top end of the flexible intermediate wall (117) bends towards the second sub-compartment (122) allowing passage of the first row (R1) of cartridges (150).

8. The cartridge package (100) according to claim 7, characterized in that the second sub-compartment (122) comprises an inclined portion (122A) at the top end (E2) of the housing (110) directing the second row (R2) of cartridges (150) towards the middle of the second compartment (135) in the mouth portion (130) of the cartridge package (100).

9. The cartridge package (100) according to claim 1, characterized in that the first row (R1) of cartridges (150) and the second row (R2) of cartridges (150) are staggered (L3) so that the outermost cartridge (150) at the top end (E2) of the housing (110) in the second row (R2) of cartridges (150) is positioned further from the top end (E2) of the housing (110) compared to the outermost cartridge (150) at the top end (E2) in the first row (R1) of cartridges (150).

10. The cartridge package (100) according to claim 1, characterized in that each slot (160, 162) extends through the bottom end (E1) of the cartridge package (100) so that the second cartridge magazine that is used for pushing the first row (R1) and the second row (R2) of cartridges (150) from the cartridge package (100) to the first cartridge magazine (200) can be positioned upon the innermost cartridge (150) in each row (R1, R2) in the cartridge package (100).

* * * * *